US005299537A

United States Patent [19]

Thompson

[11] Patent Number: 5,299,537

[45] Date of Patent: Apr. 5, 1994

[54] METERED INDUCTION TWO CYCLE ENGINE

[76] Inventor: Ransom S. Thompson, 116 N. Erie Dr., Ft. Pierce, Fla. 34946

[21] Appl. No.: 849,474

[22] Filed: Mar. 11, 1992

[51] Int. Cl.[5] ..... F02B 75/02

[52] U.S. Cl. ..... 123/72; 123/78 F

[58] Field of Search ..... 123/52 MB, 72, 68, 70 R, 123/65 B, 78 F, 65 BA

[56] References Cited

U.S. PATENT DOCUMENTS

| | | | |
|---|---|---|---|
| 924,100 | 6/1909 | Nichols | 123/531 |
| 966,362 | 8/1910 | Rundlof | 123/257 |
| 1,102,045 | 6/1914 | Hagan | 123/69 V |
| 1,168,425 | 1/1916 | Rosenhagen | 123/72 |
| 1,305,577 | 6/1919 | Wolfard | 123/53 B |
| 1,536,780 | 5/1925 | Ensign | 123/68 |
| 1,740,790 | 12/1929 | Stanton | 123/65 B |
| 2,136,293 | 11/1938 | Gentry | 123/59 BS |
| 2,202,761 | 5/1940 | Fiedler | 123/72 |
| 2,324,071 | 7/1943 | Fiedler | 123/72 |
| 2,522,649 | 9/1950 | Tenney | 123/70 R |
| 2,939,441 | 6/1960 | Luttrell | 123/70 R |
| 3,543,735 | 12/1970 | Kruckenberg et al. | 123/29 |
| 3,623,463 | 11/1971 | De Vries | 123/70 R |
| 3,633,552 | 1/1972 | Huber | 123/78 F |
| 3,774,581 | 11/1973 | Lundy | 123/70 R |
| 3,880,126 | 4/1975 | Thurston et al. | 123/70 R |
| 3,916,851 | 12/1975 | Otani | 123/73 A |
| 4,332,229 | 6/1982 | Schuit | 123/65 B |
| 4,465,035 | 8/1984 | Carr | 123/52 MB |
| 4,505,239 | 3/1985 | Deland | 123/78 F |
| 4,517,931 | 5/1985 | Nelson | 123/78 F |
| 4,827,883 | 5/1989 | Khalighi et al. | 123/52 MB |
| 4,887,560 | 12/1989 | Heniges | 123/78 F |
| 5,165,368 | 11/1992 | Schechter | 123/78 P |

*Primary Examiner*—Tony M. Argenbright
*Assistant Examiner*—M. Macy
*Attorney, Agent, or Firm*—Fishman, Dionne & Cantor

[57] ABSTRACT

A metered induction two cycle engine is presented. In accordance with the metered induction two cycle engine, an aspirating cylinder (or pulsing air-charger) is connected to a combustion cylinder by a voluminous transport duct having a valve disposed therein. The valve permits flow from the aspirating cylinder and duct to the combustion cylinder and prohibits flow in the opposite direction. The duct acts as an extension of the clearance volume of the aspirating cylinder. The valve is actuated when the pressure in the duct exceeds the pressure in the combustion cylinder. Further, the aspirating cylinder leads the combustion cylinder by a fixed amount to provide a disciplined flow of mixture (i.e., air and fuel) into the combustion cylinder.

46 Claims, 13 Drawing Sheets

METERED INDUCTION TWO CYCLE ENGINE

BACKGROUND OF THE INVENTION

This invention relates to internal combustion two cycle engines. More particularly, this invention relates to a metered induction two cycle engine.

Internal combustion two cycle engines generally comprise a compression chamber in which a fuel/air mixture (generally a fuel/oil/air mixture) is partly compressed and transferred into a combustion chamber for further compression and ignition. The two cycle engines have been configured in a variety of ways, in attempts to improve efficiency, power and other features. Examples of these attempts are represented by U.S. Pat. Nos. 2,136,293; 2,522,649; 3,543,735; 3,880,126 and 3,774,581.

A two cycle engine which does not require the mixing of fuel and oil is presented in U.S. Pat. No. 2,136,293 to Gentry. The engine of the '293 patent inducts air for combustion via a piston device and provides a passage for air to the combustion chamber. The induction of air or mixture (i.e., fuel/air) into the passage results in a full downward (i.e., induction) stroke of the piston against full manifold vacuum. The injector piston includes piston porting that requires the whole induction stroke of the piston be made against high vacuum on the piston head followed by a rush of inducted material, thus increasing the pumping losses.

An increased power two cycle engine is presented in U.S. Pat. No. 2,522,649 to Tenney, wherein porting of two pistons (and their relative size) is arranged to provide supercharging of combustion cylinder for high max output. A lack of significant clearance volume above the pumping piston to be re-expanded before drawing new charge through results in high negative pumping work during light load operation. FIG. 11 of U.S. Pat. No. 2,522,649 shows an alternate single-crank-throw variant of the basic disclosure which, coincidentally provides some re-expansion volume to the transport duct except during those portions of the induction stroke when the port is covered by the piston extension. Energy is lost in the power stroke of the combustion piston due to early release of pressure during the cycle. Further, the impingement of hot combustion gases under pressure against the pumping piston as it closes off the transfer duct is expected to result in pumping piston galling and seizure.

A two cycle diesel engine is presented in U.S. Pat. No. 3,543,735 to Kruckenberg et al. The engine includes a pumping cylinder in communication with a power cylinder via a conduit having a significant volume. The pistons are at a 90° relationship with each other. This engine is limited to diesel operation since any attempt to operate it with a throttled inlet would result in gross back-flow all the way from the exhaust manifold back through the combustion cylinder, the conduit and into the pumping cylinder area. This is caused by the air inlet port being uncovered by the piston in the pumping cylinder at about the same time that the inlet ports are covered by the piston in the power cylinder, thus precluding any recompression of the inducted gases before their exposure to exhaust conditions. Furthermore, the use of the pure piston-ported inlets constrains the inlet port opening and closing timing to fixed points in the piston stroke and precludes the use of different quantities of gas induction stroke at various load conditions.

Split cylinder engines are presented in U.S. Pat. No. 3,880,126 to Thurston et al and U.S. Pat. No. 3,774,581 to Lundy, wherein the engine includes an induction cylinder and a power cylinder with a chamber therebetween. A spark plug is disposed in the chamber for ignition of the mixture. Mechanical valves (i.e., poppet valves) are employed to control flow, which will present a severe restriction on engine operation speeds because of the relatively small portion of an engine revolution during which they must be opened and closed for two-cycle operation. No re-expansion volume is provided in open communication with the induction cylinder, which results in the stroke of the piston in the induction cylinder being made entirely against the restraining force of intake manifold vacuum. The transfer vales between the induction and combustion cylinders are subject to combustion temperature and pressure, which will restrict operating speeds, due to the heavy construction required. The engine of U.S. Pat. No. 3,774,581 includes a combination poppet and reed valve at the inlet port of the power cylinder. The reed feature of the valve allows for late opening of the intake valve and prevents development in the induction cylinder of vacuum which is even more impaired than that in the intake manifold.

Generally outboard motors are two cycle engines. These engines generally comprise a piston which moves upward in a cylinder thereby compressing a live charge above the piston prior to its ignition by a spark plug. By this upward piston motion a vacuum is created in a crankcase and a combustible gas flows into this area surrounding the crankshaft and a connecting rod through a reed valve at the crankcase. As the piston descends on its power stroke, the gases in the crankcase are compressed (i.e., the reed valve closes automatically when the crankcase pressure rises above inlet manifold pressure) until such time as the piston uncovers an intake port in the cylinder, thus allowing these compressed gases to rush into a cylinder and expel the burned gases from the last explosion into an exhaust manifold. Oil must be added to the fuel to lubricate the lower portions of the engine, since no reservoir of liquid oil may be maintained in a crankcase that is serving as a transport chamber for induction gases.

SUMMARY OF THE INVENTION

The above-discussed and other drawbacks and deficiencies of the prior art are overcome or alleviated by the metered induction two cycle engine of the present invention. In accordance with the present invention, the metered induction two cycle engine comprises an aspirating cylinder (or pulsing air-charger) in communication with a combustion cylinder via a voluminous transport duct. The aspirating cylinder has an inlet port for receiving air flow from an intake manifold through a first reed valve and an outlet port for providing flow into the transport duct, which contains a second reed valve. The first reed valve is actuated when the pressure at the intake exceeds the pressure in the aspirating cylinder. The second reed valve is actuated when the pressure in the transport duct exceeds the pressure in the combustion cylinder. The flow then enters an inlet port in the combustion cylinder. Prior to entering the combustion cylinder, fuel is introduced into the air flow, either prior to the first reed valve at the inlet port of the aspirating cylinder with a carburetion system or fuel injection system or in the duct between the aspirating cylinder and the inlet port of the combustion cylinder with a fuel injection system. Alternatively, the fuel may be injected directly into the combustion cylinder, as in the prior art Hesselman engine, and mixed with the incoming air prior to combustion. The mixture (i.e., air and fuel) in the combustion cylinder is ignited during each compression cycle of that cylinder by a spark plug which extends therein.

The added clearance volume provided to the aspirating cylinder by the duct in combination with the second reed valve provides low light-load breathing losses. Good charge stratification in the combustion cylinder to assure full, clean combustion is provided by the disciplined manner in which the combustible gasses are delivered to the combustion cylinder. The capability to operate with simple piston porting of the combustion cylinder intake and exhaust avoids prior art complications, expenses, and speed-limiting problems inherent in mechanical valve systems.

The advantages of the present invention are:

a) an engine and engine cycle in which the energy lost in other engine cycles during piston induction strokes conducted against full manifold vacuum at light engine operating loads is greatly reduced by utilizing the re-expansion of the gas in the transport duct (which is fully open to the piston-head end of the aspirating cylinder) and further reduced by the ability of this configuration to be throttled down to low power output with only moderate manifold vacuum because the system operates at low volumetric efficiency when any intake vacuum is present;

b) an engine and engine cycle in which the inducted gases are not "blasted" into the combustion chamber (i.e., combustion cylinder) by being compressed beyond the exhaust system pressure and then subsequently released into the combustion cylinder by the opening of an inlet port as in the prior art, but are fed into the combustion cylinder in a disciplined manner by the action of the piston in the aspirating cylinder after the inlet port in the combustion cylinder has already been uncovered by its piston;

c) an engine and engine cycle in which the lubricant is not required to be added to the fuel for engine lubrication; and d) an engine in which no mechanically operated valves are used.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 15A-15C are side elevation views of a linkage assembly shown in FIG. 11 wherein FIG. 15A is a view of the linkage assembly at idle, FIG. 15B is a view of the linkage assembly at cruise, and FIG. 15C is a view of the linkage at full throttle;

DESCRIPTION OF THE PREFERRED EMBODIMENT

Figures 1, 3, 4, 5, 6, 7, 8:
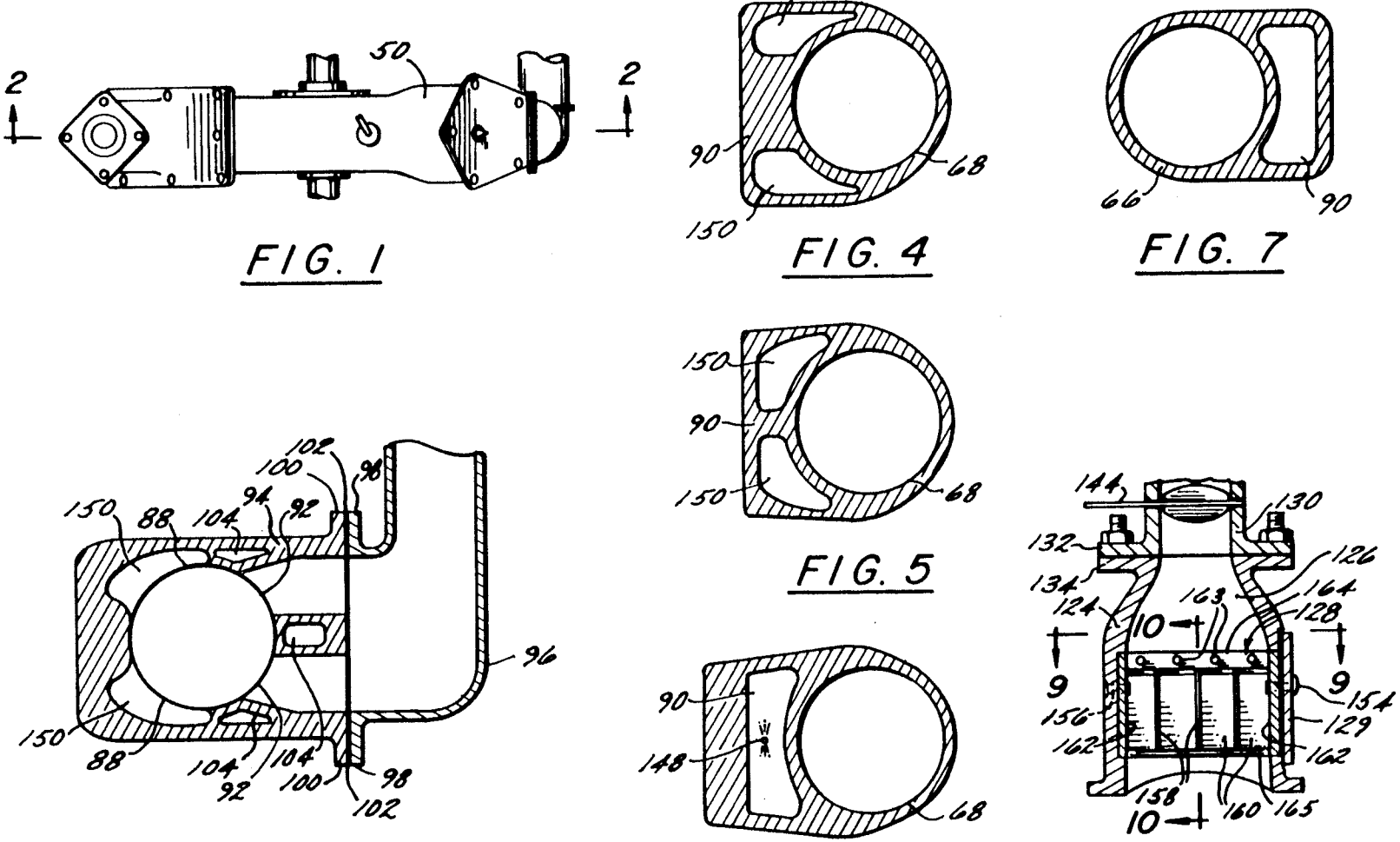
FIG. 1 is a top view of a first embodiment of a metered induction two cycle engine in accordance with the present invention.
FIG. 3 is a view taken along the line 3—3 of FIG. 2.
FIG. 4 is a view taken along the line 4—4 of FIG. 2.
FIG. 5 is a view taken along the line 5—5 of FIG. 2.
FIG. 6 is a view taken along the line 6—6 of FIG. 2.
FIG. 7 is a view taken along the line 7—7 of FIG. 2.
FIG. 8 is a view taken along the line 8—8 of FIG. 2.
Figure 2:
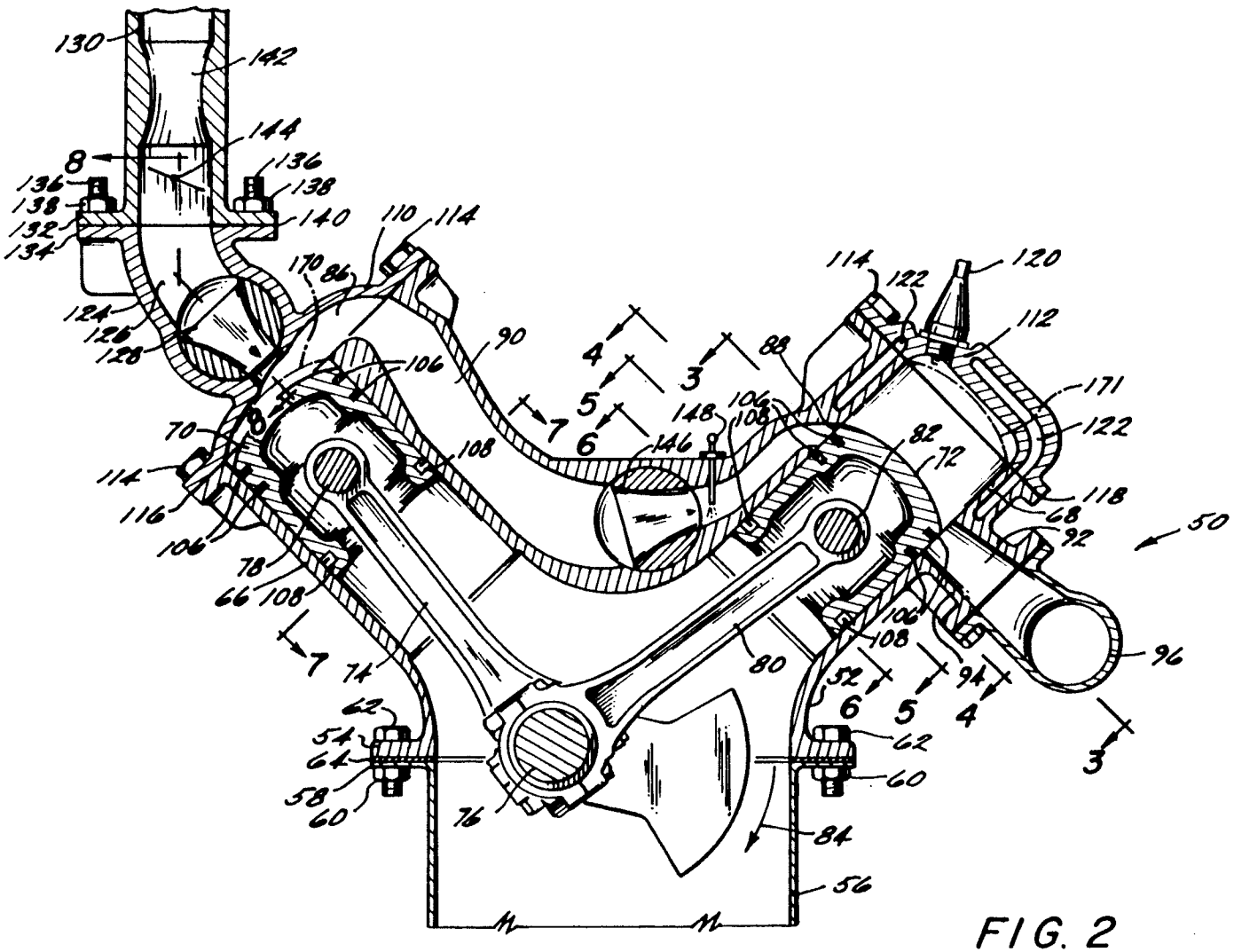
FIG. 2 is a view taken along the line 2—2 of FIG. 1.

Referring to FIGS. 1, 2 and 3, a metered induction two cycle engine in accordance with a first embodiment of the present invention is shown generally at 50. Engine 50 comprises a cylinder block 52 having a flange 54 and a crankcase 56 having a flange 58. Block 52 and crankcase 56 are connected together at flanges 54 and 58 by nuts 60 and bolts 62. A gasket 64 is disposed between flanges 54 and 58 for sealing a lubricant therein. Block 52 includes an aspirating cylinder 66 and a combustion cylinder 68. A first piston 70 is reciprocally mounted in cylinder 66 and a second piston 72 is reciprocally mounted in cylinder 68. A connecting rod 74 journaled on a crankshaft 76 is connected by a wrist pin 78 to piston 70. Another connecting rod 80 journaled on crankshaft 76 is connected by a wrist pin 82 to piston 72. Crankshaft 76 rotates in a clockwise direction, as is shown by an arrow 84.

An outlet port 86 which communicates with cylinder 66 and inlet ports 88 in cylinder 68 are connected by a transport duct 90. Duct 90 is preferably formed as part of block 52. Exhaust ports 92 through an extension 94 of cylinder 68 serve to discharge products of combustion in cylinder 68. An exhaust manifold 96 having a flange 98 is connected to a flange 100 of extension 94. A gasket 102 is disposed between flanges 98 and 100. Channels 104 in extension 94 define passages for a coolant. Preferably the coolant is a liquid coolant for a liquid cooled engine, although engine 50 may be an air cooled engine. Further, exhaust manifold 96 is generally connected to extension 94 by nuts and bolts (not shown).

Each piston 70 and 72 includes a pair of compression rings 106 and an oil control ring 108. Rings 108 prevent oil in the crankshaft area from reaching ports 86, 88 and 92. Cylinders 66 and 68 include cylinder heads 110 and 112 respectively. Heads 110 and 112 are connected to respective cylinders 66, 68 by nuts 114. Gaskets 116 and 118 are disposed between respective cylinder heads 110, 112 and cylinders 66, 68.

Cylinder head 112 includes an opening for mounting a spark plug 120 therein. Channels 122 in head 112 and cylinder 68 define passages for the coolant. Cylinder head 110 defines port 86 and a portion of duct 90, and head 110 includes an extension 124 having a passage 126 for air intake. Referring also to FIG. 8 a first reed valve assembly 128 is disposed in passage 126. Reed valve assembly 128 allows flow in one direction (i.e., into the engine) and prohibits flow in the opposite direction. Valve assembly 128 is secured by an integral mounting plate 129 which is mounted to extension 124, thereby retaining valve assembly 128 in passage 126. An air duct 130 with flange 132 is connected to a flange 134 of extension 124 with studs 136 and nuts 138. A gasket 140 is disposed between flanges 132 and 134. An air intake measuring venturi 142 is disposed in duct 130 directly above a throttle valve 144.

A second reed valve assembly 146 is disposed in duct 90 allowing flow from port 86 to ports 88 and prohibiting flow from ports 88 to port 86. A fuel injection nozzle 148 extends through an opening into duct 90 between reed valve assembly 146 and ports 88.

Referring also to FIGS. 3–7, the interior profile of duct 90 is shown in a series of sectional views. Ports 88 (FIGS. 2 and 3) interfaces with corresponding sections 150 of duct 90, as is best shown in FIG. 3. Sections 150 gradually merge together forming a single passage (FIG. 6). Duct 90 remains a single passage (FIG. 7) up to port 86. Transport duct 90 acts as an extension of the clearance volume of cylinder 66 that terminates at reed valve assembly 146.

Figure 10:
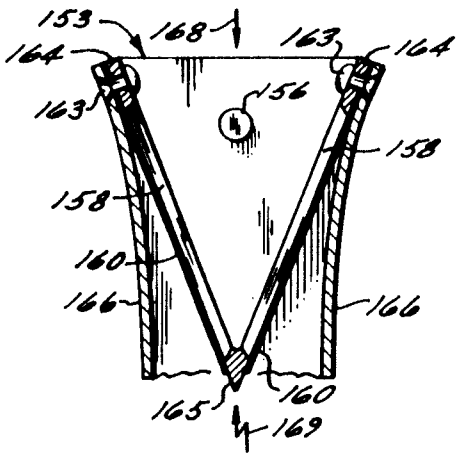
FIG. 10 is an enlarged view taken along the line 10—10 of FIG. 9.
Figure 9:
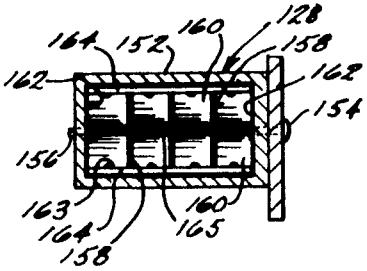
FIG. 9 is a view taken along the line 9—9 of FIG. 8.

Reed valve assemblies 128 and 146 are the same type, so only valve assembly 128 is described in detail. Referring to FIGS. 8–10, reed valve assembly 128 comprises a holder 152 (with an integral mounting flange 129) and a reed-valve sub-assembly 153, which is held in holder 152 by a button head rivet 154 at the flange end and by a second rivet 156, preferably a short countersunk type rivet, at the other end. Reed valve sub-assembly 153 includes a plurality of reeds 160, assembly rivets 163, over travel stops at 166, and a support member 158 which incorporates end portions 162, side rails 164 and an apex rail 165. Reeds 160 open to allow flow in the direction indicated by an arrow 168 and close to prohibit flow in the direction indicated by an arrow 169. Thus, when the pressure of flow in the direction of arrow 168 is greater than the pressure of flow in the direction of arrow 169 valve 128 will open. Otherwise, valve 128 is closed.

Pistons 70 and 72 (FIG. 2) are configured to insure that piston 70 reaches the top of its stroke, indicated by a broken line 170 and referred herein as top dead center position (TDC), when piston 72 has risen far enough from the bottom of its stroke, referred to herein as bottom dead center position (BDC), to cover inlet ports 88. It is preferred that the TDC of piston 70 is set to occur between 75° and 160° before piston 72 reaches its TDC, indicated by a broken line 171.

Reed valve assemblies 128 and 146 prevent back-flow of gases during engine cycles. Reed valve assembly 128 prevents the return of inducted mixture from cylinder 66 area to passage 126 when the pressure in cylinder 66 is increased by the upward motion of piston 70. Similarly, reed valve assembly 146 prevents the return of exhaust gases from cylinder 68 to duct 90 when ports 88 are first uncovered by the downward motion of piston 72.

Figure 35:
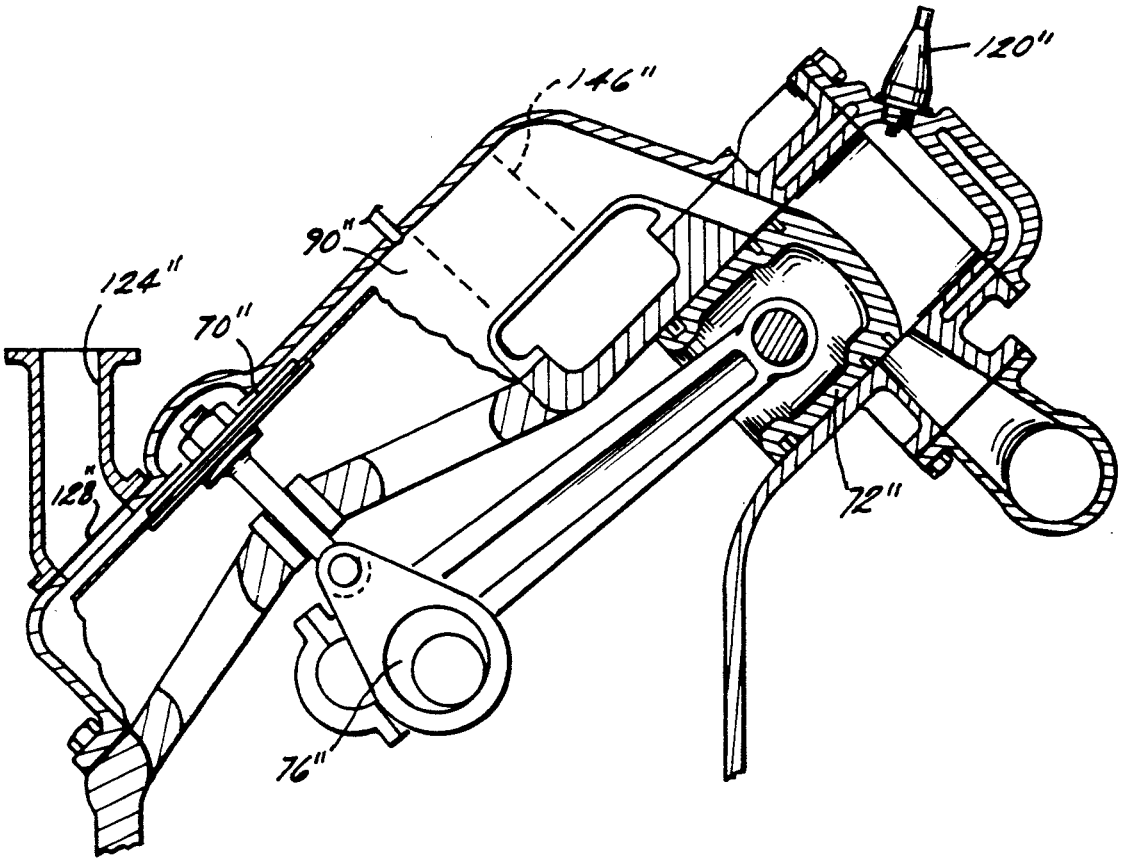
FIG. 35 is a generally cross sectional side elevation view of the engine of FIG. 1 employing a diaphragm.

Piston 70 in cylinder 66 may be replaced by a lighter-construction, large-diameter, short-stroke piston and cylinder unit actuated by a separate crank throw on the main shaft located to produce actuation at the required lead time with respect to piston 72 in cylinder 68, or even by a friction-free, large-diameter diaphragm 70" (FIG. 35) actuated in the same manner, providing that alternating compressions and expansions of the engine inlet fluids be at the correct timing with respect to the motion of piston 72" and in a manner to approximate the reversible adiabatic processes. The engine 50" of FIG. 35 is otherwise similar to engine 50 with common elements designated by double primed numbers.

During operation, when piston 72 is on its upward (i.e., compression) stroke and has risen enough to cover ports 88, the pressure in transfer duct 90 is slightly above atmospheric pressure and piston 70 is near its TDC position 170, due to the lead angle with respect to piston 72. As piston 72 continues its compression stroke (i.e., upward), piston 70 will start its downward stroke which will reduce the pressure in transport duct 90 and associated cylinder 66 area, except for that portion of duct 90 which is downstream of reed valve assembly 146 (i.e., to the right of valve assembly 146 as shown in FIG. 2) wherein a pocket of above atmospheric pressure inlet mixture is trapped. The downward motion of piston 70 will continue to reduce the pressure in cylinder 66 and transport duct 90 until it reaches a value below that in passage 126, at which point air will begin to flow through reed valve assembly 128 into cylinder 66 and duct 90. This flow will continue until piston 70 reaches its BDC, thus inducting a portion of air (i.e., an air charge) into the cylinder 66 and duct 90 area.

Due to the timing difference between pistons 70 and 72, the compression stroke and a considerable portion of the power stroke of piston 72 will both have been accomplished by the time the induction process in cylinder 66 is completed. As piston 72 proceeds downward, uncovering the exhaust and inlet ports 92 and 88, piston 70 is recompressing air in transport duct 90 as piston 70 rises on its upward stroke. After piston 72 has uncovered inlet ports 88 and the pressure in duct 90 has been raised to the level of that existing in cylinder 68, further upward motion of piston 70 will provide a disciplined flow into cylinder 68 that may be directed to the ignition side of cylinder 68 by the use of porting configurations commonly used on loop scavenged two stroke cycle engines, thus displacing previously burned gases remaining in cylinder 68 to the non-ignition side of cylinder 68 (i.e., near ports 92), where any unburned hydrocarbons may be reduced or eliminated by repeated combustion. The flow of air through reed valve assembly 146 into cylinder 68 will continue until the rise of piston 72 (i.e., compression stroke) covers ports 88, which thus completes the cycle.

The relationship of the swept volume (i.e., piston displacement) of cylinder 66 to the swept volume of cylinder 68 is preferably a one-to-one relationship. Further, the clearance volume of cylinder 66 with piston 70 at its TDC and duct 90 is preferably equal to the swept volume of cylinder 66. However, duct 90 may have a volume of less than the swept volume of cylinder 66 (e.g. one-half the volume of cylinder 66) and still operate reasonably well. When utilizing the above-noted preferred volume ratios, and assuming that a transfer duct pressure of 1.10 atmospheres is required for flow through reed valve assembly 146 and a maximum induction pressure of 0.90 atmospheres downstream of reed valve assembly 128, the full throttle flow into cylinder 68 is about 70% of its gross piston displacement, which is all that can be handled with good economy and no waste through-flow. With an induction pressure of 0.50 atmosphere downstream of reed valve 128 the flow into cylinder 68 is reduced to about 14% of its gross piston displacement, which should still just maintain idling power considering the low induction air pumping losses to be overcome in the engine.

The work involved in the compression and expansion of the air above piston 70 tends to balance out, except during portions of the piston strokes when air is being actually delivered through reed valve 128 or reed valve 146. The actual air handling power extracted from the main engine shaft to deliver the air/fuel mixture to cylinder 68 varies from a moderate value at full throttle conditions to lower values as the throttle opening is progressively reduced until the pressure in duct 90 is sufficiently reduced to prevent any air from being delivered through reed valve assembly 146.

Figure 11:
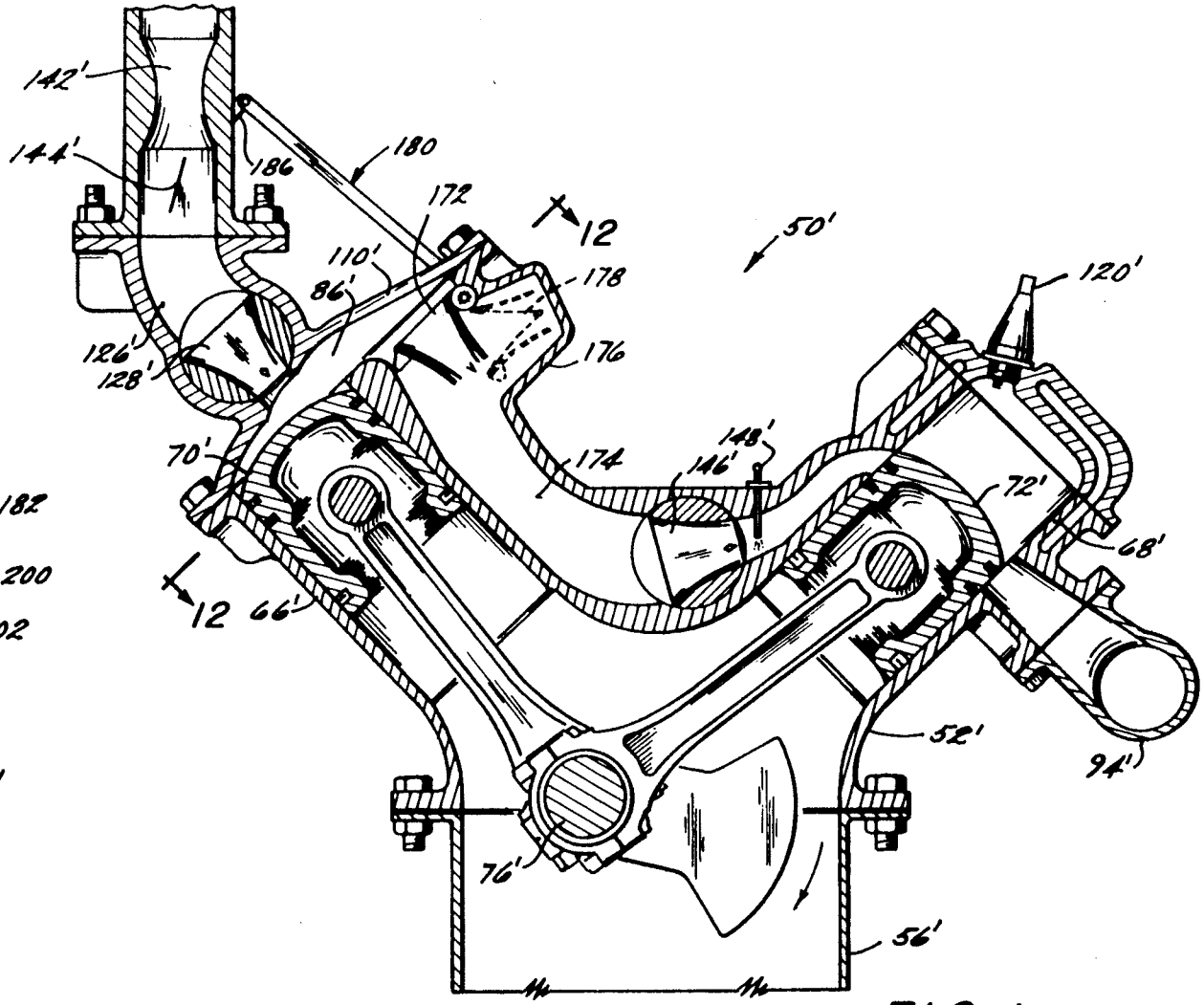
FIG. 11 is a generally vertically sectioned view of a second embodiment of a metered induction two cycle engine in accordance with the present invention.

Referring to FIG. 11, wherein like elements to the FIG. 2 embodiment are designated by primed numbers, in a second embodiment of the present invention an engine 50' is shown having a third reed valve 172 at the end of a transport duct 174 86'. Duct 174 is the same as duct 90 (FIG. 2) except for a recess 176 wherein valve 172 is stowed during normal operation. Reed valve 172 is shown stowed in recess 176 by broken lines 178. Further, cylinder head 110' is extended to compensate for the addition of recess 176. Reed valve 172 is the same as reed valve assembly 153 described in the first embodiment.

Figure 15A:
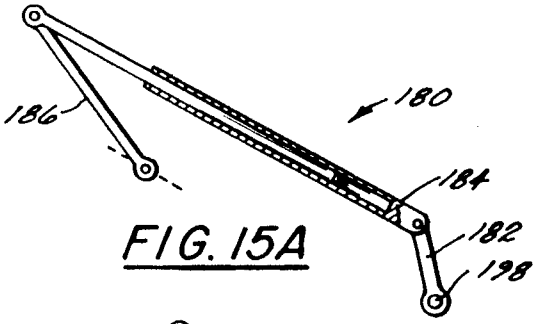
Figure 15B:
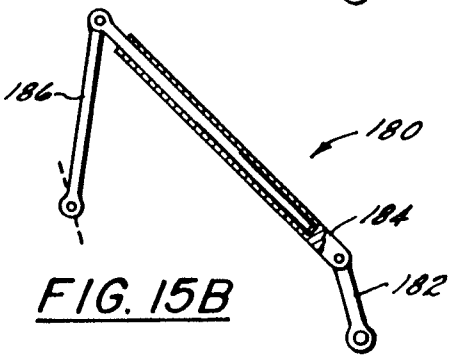
Figure 15C:
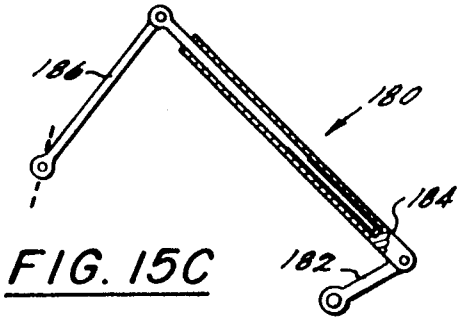
Figure 14:
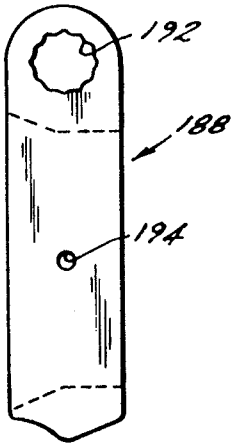
FIG. 14 is an end view of the mounting frame of FIG. 13.
Figure 13:
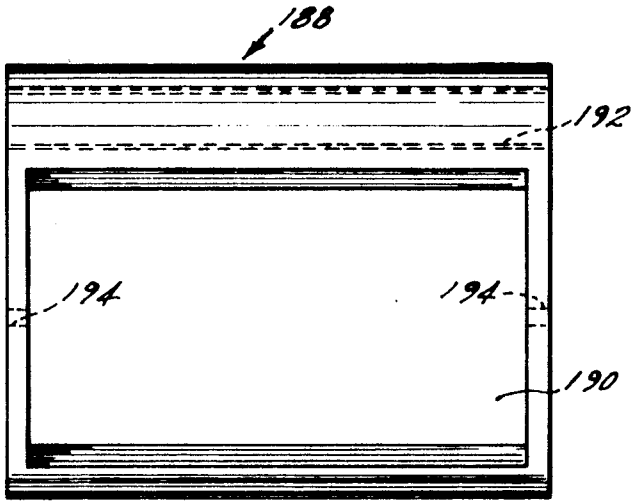
FIG. 13 is a to view of a mounting frame shown in FIG. 12.
Figure 12:
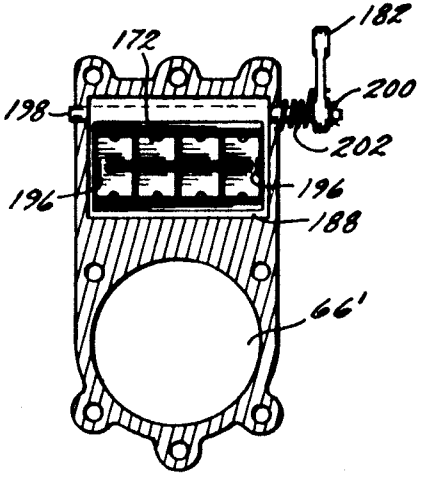
FIG. 12 is a view taken along the line 12—12 of FIG. 11.

Referring to FIGS. 12–14, reed valve 172 is mounted on a frame 188. Frame 188 comprises a generally rectangular shape having a rectangular opening 190, a splined opening 192 and a pair of mounting holes 194. Valve 172 is retained on frame 188 by rivets 196 at each end of valve 172. An actuating shaft 198 is disposed in opening 192. Shaft 198 is splined so as to fit into opening 192 without rotating therein. One end of shaft 198 is connected to splined actuating arm 182 and is retained thereto by a pin 200 through an aperture in shaft 198. Frame 188 and thereby valve 172 are biased in the stowed position 178 by a spring 202. Valve 172 is moved into duct 174 by the rotation of shaft 198. Shaft 198 rotates in unison with arm 182. The rotation of arm 182 is best shown in the sequential FIGS. 15A–15C.

Reed valve 172 is stowed in recess 176 except during wide open throttle operation. Location of valve 172 is controlled by linkage 180. Referring also to FIGS. 12 and 15A–15C linkage 180 includes an actuating arm 182, the extended end of which is pivotally connected to actuating sleeve 184, in which actuating rod 185 is free to slide until the enclosed end of rod 185 bottoms against the solid end of sleeve 184. The extended end of rod 185 is pivotally connected to throttle actuating arm 186.

The addition of reed valve 172 results in a power increase when positioned in duct 174. Reed valve 172 acts to trap inlet air (that is at pressure levels sufficient to cause flow into cylinder 68', i.e., above atmospheric pressure) in duct 174 and also to reduce the effective clearance volume of cylinder 66'. The increased transport duct pressure initiates flow into cylinder 68' at the earliest possible point in the cycle, and the reduced effective clearance volume of cylinder 66' enables cylinder 66' to deliver nearly a full piston displacement of air at each stroke of piston 70'. The resultant filling of cylinder 68' provides a maximum power charge in cylinder 68' and results in some waste through-flow of fresh fuel/air mixture through cylinder 68'and out into exhaust duct 94'.

Referring now to FIGS. 23–28 in a third and preferred embodiment of the present invention, an engine 306 is shown employing a pulsing air-charger 308. Engine 306 comprises a cylinder block 310 connected to a crankcase 311. A gasket (not shown) is disposed between block 310 and crankcase 311. Block 310 includes two combustion cylinders 314 and 316. Aspiration is provided by pulsing air-charger 308. Pistons 318 and 320 are reciprocally mounted in corresponding cylinders 314 and 316. A connecting rod 322 journaled on a crankshaft 324 is connected by a wrist pin 326 to piston 318. Another connecting rod 328 journaled on crankshaft 324 is connected by a wrist pin 330 to piston 320. Crankshaft 324 rotates in a clockwise direction, as is shown by an arrow 332.

Pulsing air-charger 308 includes an oscillating vane 334 pivotally mounted in a volumous aspirating enclosure 336, wherein vane 334 includes a seal (i.e., a plurality of outwardly extending fins 337) between vane 334 and the interior surfaces of enclosure 336. A connecting rod 338 is journaled on crankshaft 324 and connected to an actuating arm 340 by a crank pin 342. The other end of arm 340 is connected to vane 334 at a shaft 344. A counterweight 345' is located at the other end of shaft 344.

Referring also to FIGS. 29–32, a first port 346 in enclosure 336 and inlet ports 348 in cylinder 314 are connected by a first transport duct 350 via a port 351. A second port 352 in enclosure 336 and inlet ports 349 in cylinder 316 are connected by a second transport duct 354 via a port 355. Ducts 350 and 354 are connected to block 310 by nuts 353. An exhaust port 356 through an extension 358 of cylinder 314 serves to discharge products of combustion in cylinder 314. Cylinder 316 also includes an exhaust port 357 through an extension of cylinder 316 which serves to discharge products of combustion in cylinder 316. An exhaust manifold 360 having a flange 362 is connected to a flange 363 of extension 358. Exhaust manifold 360 is also connected to the extension of cylinder 316. Manifold 360 is generally connected to extension 358 of cylinder 314 and the extension of cylinder 316 by nuts and bolts 361.

Each piston 318 and 320 includes a pair of compression rings 364 and an oil control ring 365. Rings 365 prevent oil in the crankshaft area from reaching the intake and exhaust ports of cylinders 314 and 316. Cylinders 314 and 316 include a cylinder head 366. A gasket 370 is disposed between cylinder head 366 and cylinders 314, 316.

Cylinder head 366 includes openings for mounting corresponding spark plugs 374 and 376 therein. Channels 378 in cylinders 314, 316 and cylinder head 366 defined passages for a coolant. Preferably, the coolant is a liquid coolant for a liquid cooled engine, although engine 306 may be an air cooled engine.

Intake manifolds 379 communicate with ports 346 and 352 via ports 346' and 352' respectively. A first reed valve 380 is disposed near port 346 allowing flow from intake manifold 379 to enclosure 336 and prohibiting flow from enclosure 336 and duct 350 to intake manifold 379. A second reed valve 382 is disposed in duct 350 allowing flow from port 346 to port 348 and prohibiting flow from port 348 to port 346. A first fuel injection nozzle 384 extends through an opening in duct 350 between reed valve 382 and port 348. A third reed valve 386 is disposed near port 352 allowing flow from intake manifold 379 to enclosure 336 and prohibiting flow from enclosure 336 and duct 354 to intake manifold 379. A fourth reed valve 383 is disposed in duct 354 allowing flow from port 352 to the inlet port 349 of cylinder 316 and prohibiting flow from the inlet port 349 of cylinder 316 to port 352. A second fuel injection nozzle 385 extends through an opening in duct 354 between the fourth reed valve and the inlet port 349 in cylinder 316. Reed valves 380 and 386 are the same as reed valve assembly 153 described in the first embodiment and are installed in reed valve holders 381. Reed valves 382 and 383 are the same as reed valve assembly 153 described in the first embodiment and are installed in reed valve holder 410, having an integral mounting flange 411.

Pistons 318, 320 and vane 334 are configured to insure that vane 334 reaches the top of its stroke when piston 318 has risen far enough from the bottom of its stroke (i.e., BDC), to cover inlet port 348. Further, that vane 334 reaches the bottom of its stroke when piston 320 has risen for enough from the bottom of its stroke (i.e., BDC) to cover the inlet port in cylinder 316. It should be noted that pistons 318 and 320 are 180° out of phase (i.e., piston 318 is at its TDC when piston 320 is at its BDC and piston 318 is at its BDC when piston 320 is at its TDC). The top dead center position (TDC) of pistons 318 and 320 are indicated by broken lines 388 and 390 respectively.

Reed valves 380, 382, 386 and the fourth reed valve prevent back-flow of gases during engine cycles. Reed valve 380 prevents the return of inducted air (or mixture with a carbureted engine) from enclosure 336 to intake manifold 379 when the pressure in the upper portion of enclosure 336 is increased by the upward motion of vane 334. In the same way reed valve 386 prevents the return of inducted air from enclosure 336 to intake manifold 379 when the pressure in the lower portion of enclosure 336 is increased by the downward motion of vane 334. Reed valve 382 prevents the return of exhaust gasses from cylinder 314 to duct 350 when port 348 is first uncovered by the downward motion of piston 318. The fourth reed valve 383 prevents the return of exhaust gases from cylinder 316 to duct 354 when the inlet port in cylinder 316 is first uncovered by the downward motion of piston 320.

Figure 34:
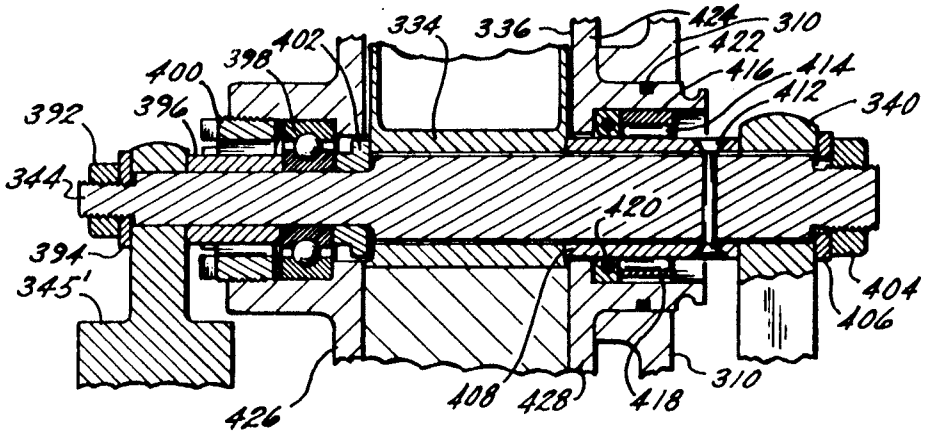
FIG. 34 is an enlarged view taken along the line 34—34 of FIG. 33.
Figure 33:
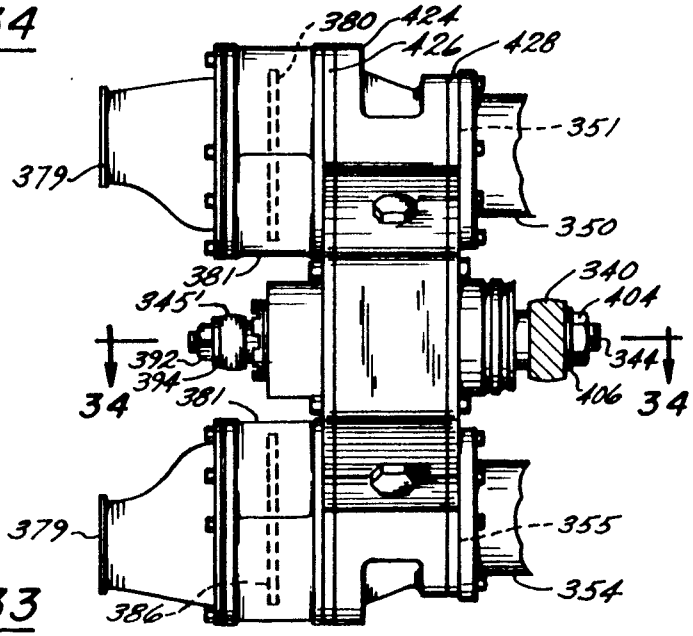
FIG. 33 is a side view of the pulsing air-charger portion of the engine of FIG. 23.
Figure 29:
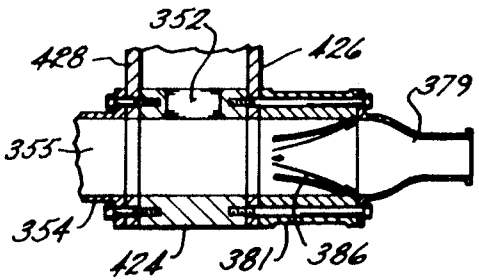
FIG. 29 is a view taken along the line 29—29 of FIG. 25.
Figure 30:
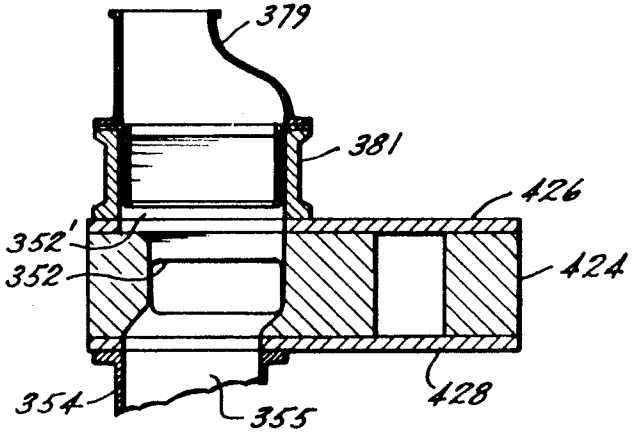
FIG. 30 is a view taken along the line 30—30 of FIG. 25.
Figure 31:
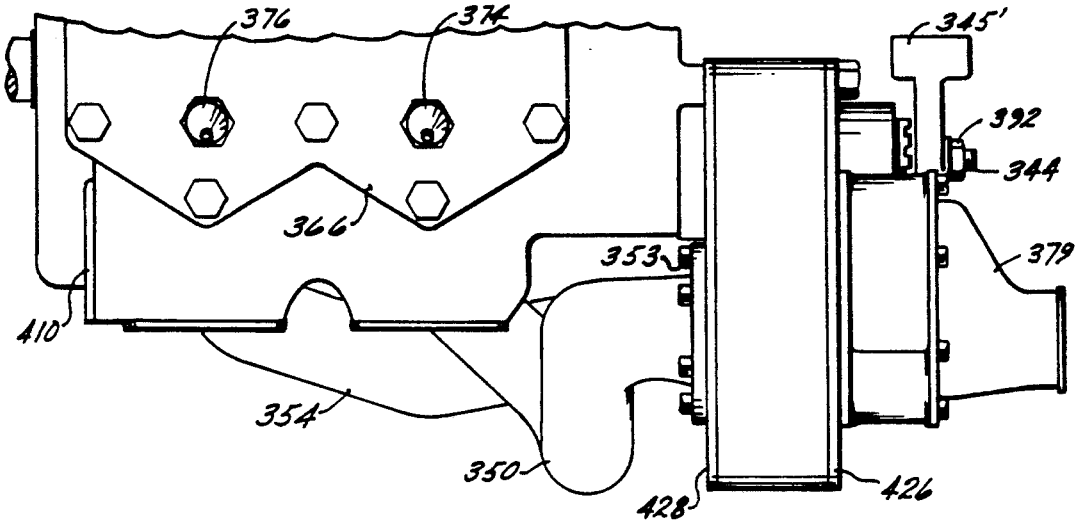
FIG. 31 is a partial top view of the engine of FIG. 23.
Figure 32:
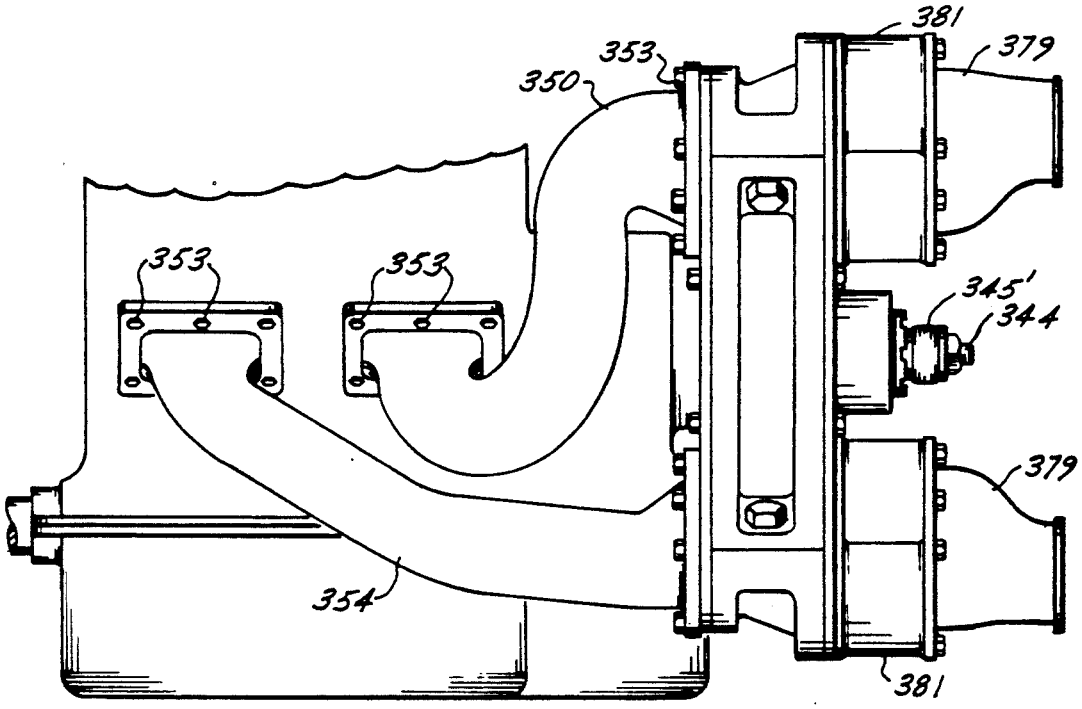
FIG. 32 is a partial side elevational view of the engine of FIG. 23.

Referring now to FIGS. 33 and 34, shaft 344 has counterweight 345' secured at one end by a nut 392 and washer 394. A spacer 396 is located on shaft 324 between counterweight 345' and a thrust bearing 398. A retaining nut 400 is used to secure bearing 398. Vane 334 is positioned at about the center of shaft 344. A spacer 402 is disposed between vane 334 and bearing 398. Arm 340 is secured at the other end of shaft 344 by a nut 404 and washer 406. A spacer 408 is located between arm 340 and vane 334. A rivet 412 locates spacer 408 on shaft 344 to provide correct positioning of vane 334 and arm 340. A roller bearing 414 and a roller bearing sleeve 416 have an oil drain groove 418 positioned between enclosure 336 and spacer 408. A seal 420 prevents oil at bearing 414 from entering enclosure 336. Another seal 422 provide an air seal between a casing 424 and cylinder block 310. Casing 424 defines enclosure 336 (FIG. 25A) and includes ends 426 and 428, outer and inner arcs 430 and 432 and ported sides 434 and 436. It will be appreciated that enclosure 336 is located within casing 424.

During operation, when piston 318 is on its upward stroke and has risen enough to cover port 348, the pressure in transfer duct 350 is slightly above atmospheric pressure and vane 334 is near its top position, due to the lead angle with respect to piston 318. At the same time piston 320 is on its downward stroke. As piston 318 continues its upward stroke, vane 334 will start its downward stroke which will reduce the pressure in transport duct 350, except for that portion of duct 350 which is downstream of reed valve 382 wherein a pocket of above atmospheric pressure inlet mixture is trapped. As piston 320 continues its downward stroke, uncovering the exhaust and inlet ports, vane 334 is recompressing air in transport duct 354 as vane 334 moves downwardly. The downwardly stroke of vane 334 also continues to reduce the pressure in transport duct 350 until it reaches a value below that in intake manifold 379, at which point air will begin to flow through reed valve 380 into the upper portion of enclosure 336 and duct 350.

After piston 320 has uncovered the inlet port in cylinder 316 and the pressure in duct 354 has been raised to the level of that existing in cylinder 316, further downward motion of vane 334 will provide a disciplined flow into cylinder 316 that may be directed to the ignition side of cylinder 316 by the use of porting configurations commonly used on loop scavenged two stroke cycle engines, thus displacing previously burned gases remaining in cylinder 316 to the non-ignition side of cylinder 316 (i.e., near port 356), where any unburned hydrocarbons may be reduced or eliminated by repeated combustion. The flow of air through the fourth reed valve 383 into cylinder 316 will continue until the rise of piston 320 covers the inlet port in cylinder 316. At which time piston 318 is on its downward stroke.

As piston 320 continues its upward stroke, vane 334 will start its upward stroke which will reduce the pressure in transport duct 354, except for that portion of duct 354 which is downstream of the fourth reed valve wherein a pocket of above atmospheric pressure inlet mixture is trapped. As piston 318 continues its downward stroke, uncovering exhaust and inlet ports 356 and 348, vane 334 is recompressing air in transport duct 350 as vane 334 moves upwardly. The upward stroke of vane 334 also continues to reduce the pressure in transport duct 354 until it reaches a value below that in intake manifold 379, at which point air will begin to flow through reed valve 386 into the lower portion of enclosure 336 and duct 354.

After piston 318 has uncovered the inlet port 348 and the pressure in duct 350 has been raised to the level of that existing in cylinder 314, further upward motion of vane 334 will provide a disciplined flow into cylinder 314 that may be directed to the ignition side of cylinder 314 by the use of common porting configurations, as described for cylinder 316. The flow of air through reed valve 382 into cylinder 314 will continue until the rise of piston 318 covers inlet port 348, which thus completes the cycle.

Pulsing air-charger 308 greatly reduces the possibility of contamination of the charge fluid by lubricating oil, whereas the piston-ring lubrication required in the aspirating cylinders of the prior art presents a definite hazard. Any charge leakage past the sealing surfaces of pulsing air-charger 308 only leaks into an adjoining charge chamber and not into an area containing lubricating oil. Any such possible leakage can easily be compensated for by a very minor increase in capacity. The friction power requirements of pulsing air-chargers 308 are extremely low due to its lack of piston rings or other high friction sealing devices.

Pulsing air-charger 308 is exposed during engine operations to temperature and pressure conditions which vary only slightly from ambient atmospheric. Accordingly, vane 334 may be constructed as a hollow body of light-weight material. Such construction will permit a small counterweight 345 to be used at the opposite end of shaft 324 from actuating arm 340 and in the same angular position as actuating arm 340. The center-of-gravity will then be located at the center of shaft 344. This eliminates any unbalanced forces from vane 334 actuation and results in only a cyclicly varying torque about shaft 324. Vibrations will become undetectable as these torque variations of shaft 324 are in the same plane as the engine output torque variations.

Figure 16:
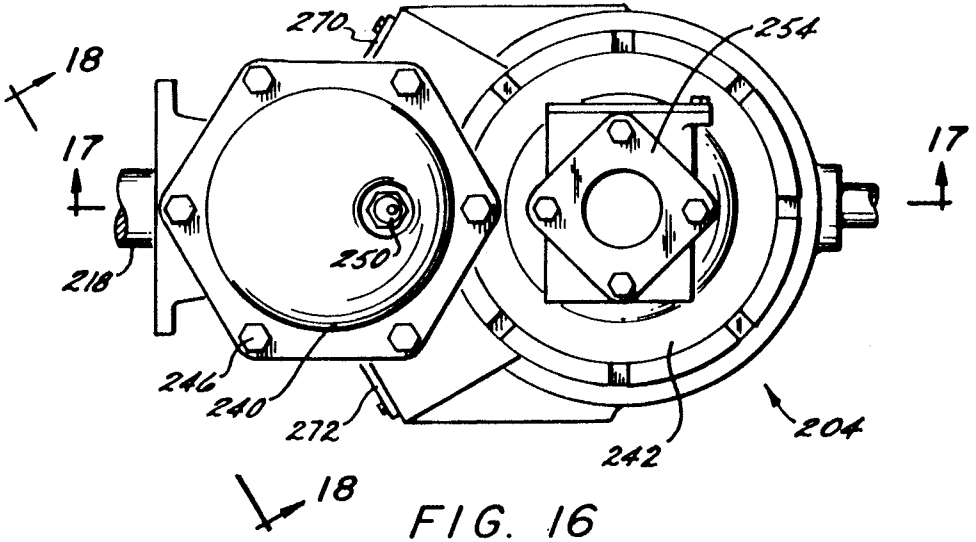
FIG. 16 is a top view of a fourth embodiment of a metered induction two cycle engine in accordance with the present invention.
Figure 17:
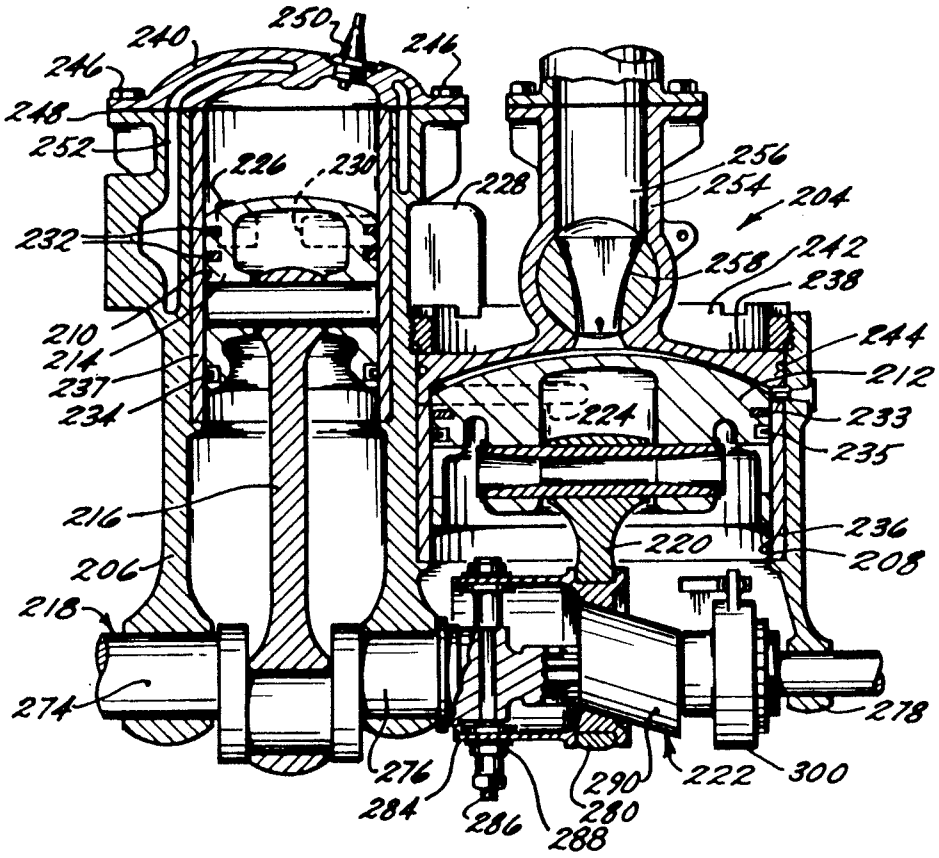
FIG. 17 is a view taken along the line 17—17 of FIG. 16.

Referring to FIGS. 16 and 17, in a fourth embodiment of the present invention a variable stroke metered induction two cycle engine is shown generally at 204. Engine 204 comprises a cylinder block 206 having an aspirating cylinder 208 and a combustion cylinder 210. A first piston 212 is reciprocally mounted in cylinder 208 and second piston 214 is reciprocally mounted in cylinder 210. A connecting rod 216 journaled on a shaft 218 is connected to piston 214. Another connecting rod 220 journaled on shaft 218 by a variable stroke assembly 222 is connected to piston 212.

Figure 22B:
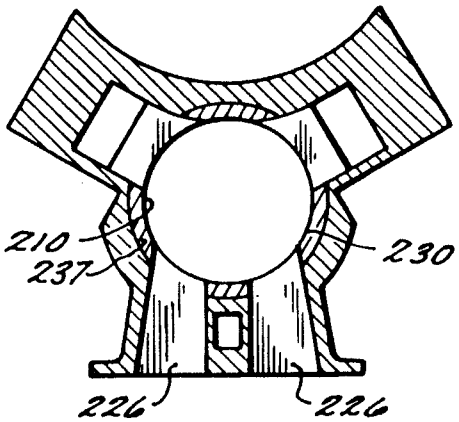
FIG. 22B is a view taken along the line 22B—22B of FIG. 18.
Figure 22A:
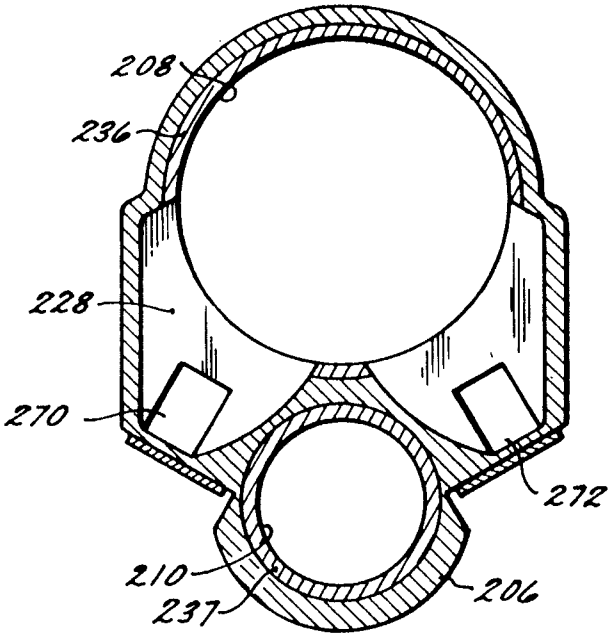
FIG. 22A is a view taken along the line 22A—22A of FIG. 18.
Figure 18:
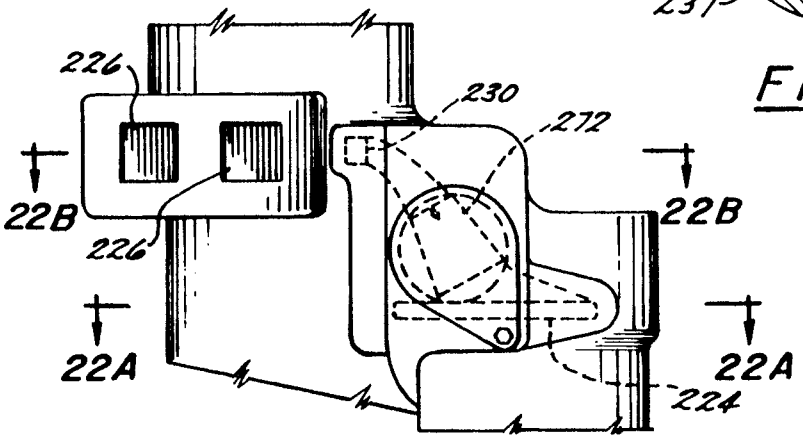
FIG. 18 is a view taken along the line 18—18 of FIG. 16.
Figure 23:
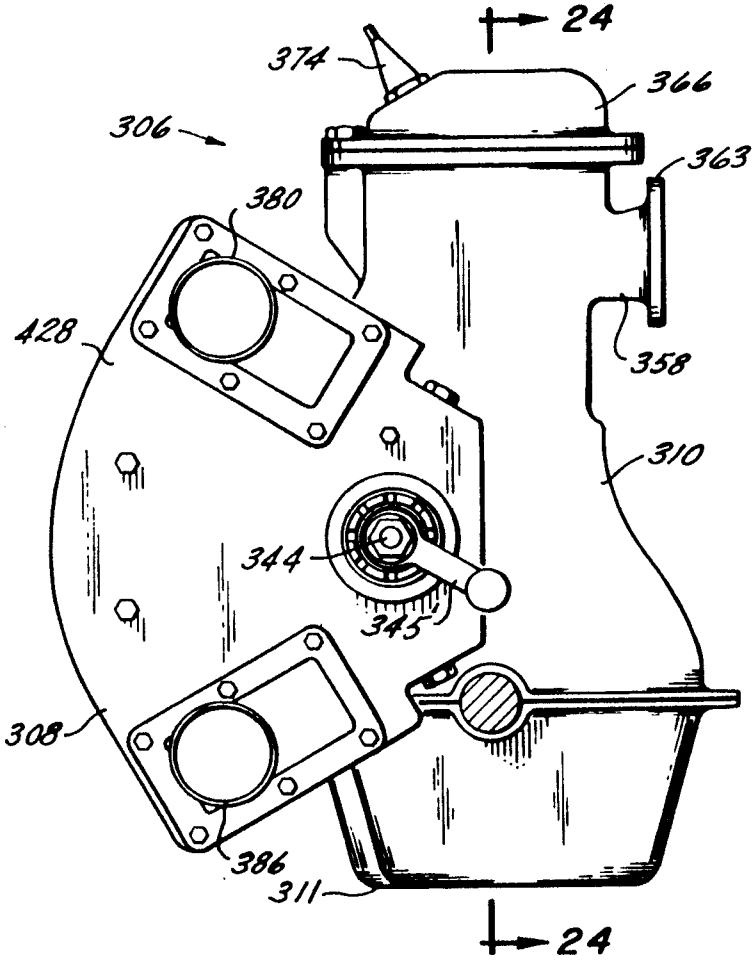
FIG. 23 is a front view partially cross sectioned of a third and preferred embodiment of a metered induction two cycle engine in accordance with the present invention.
Figure 24:
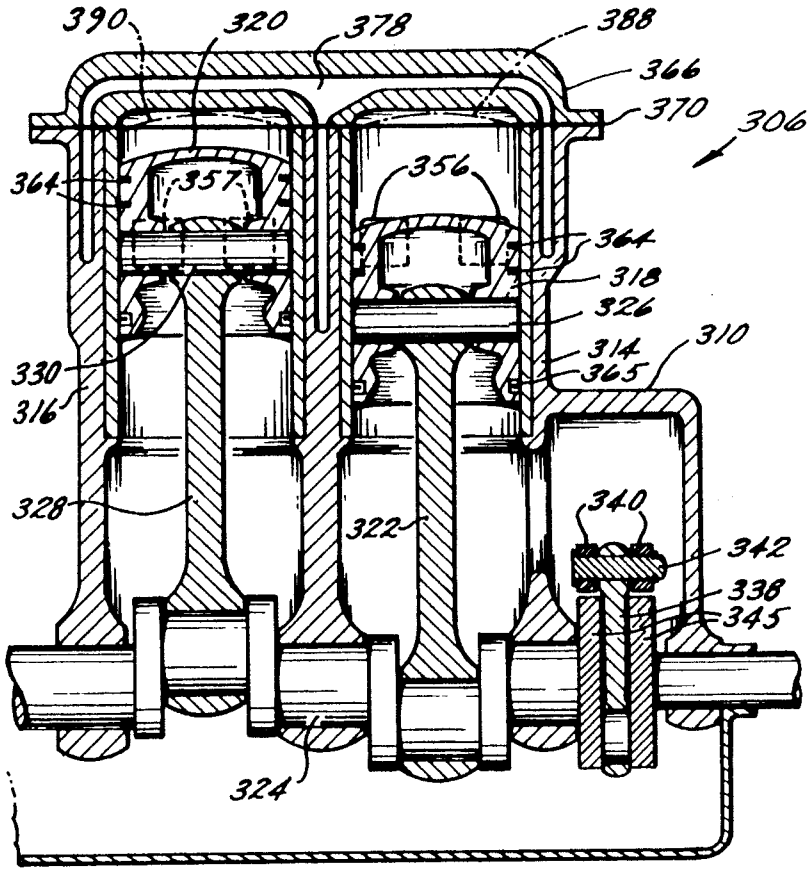
FIG. 24 is a view taken along the line 24—24 of FIG. 23.
Figures 25, 25A, 26:
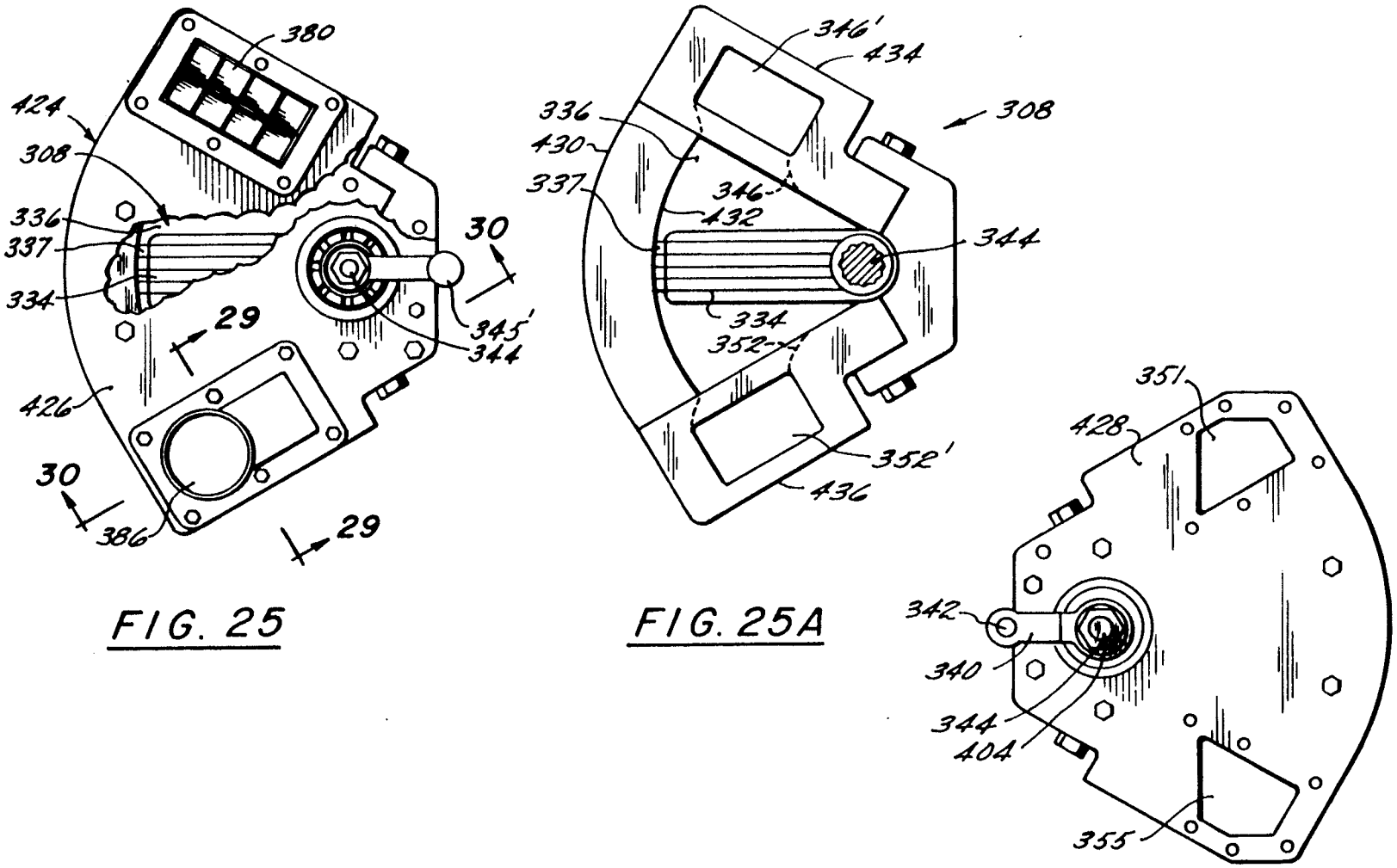
FIG. 25 is a first end view of the pulsing air-charger shown in FIG. 23.
FIG. 25A is an end view exposing the interior of the pulsing air-charger shown in FIG. 23.
FIG. 26 is a second end view of the pulsing air-charger shown in FIG. 23.
Figure 27:
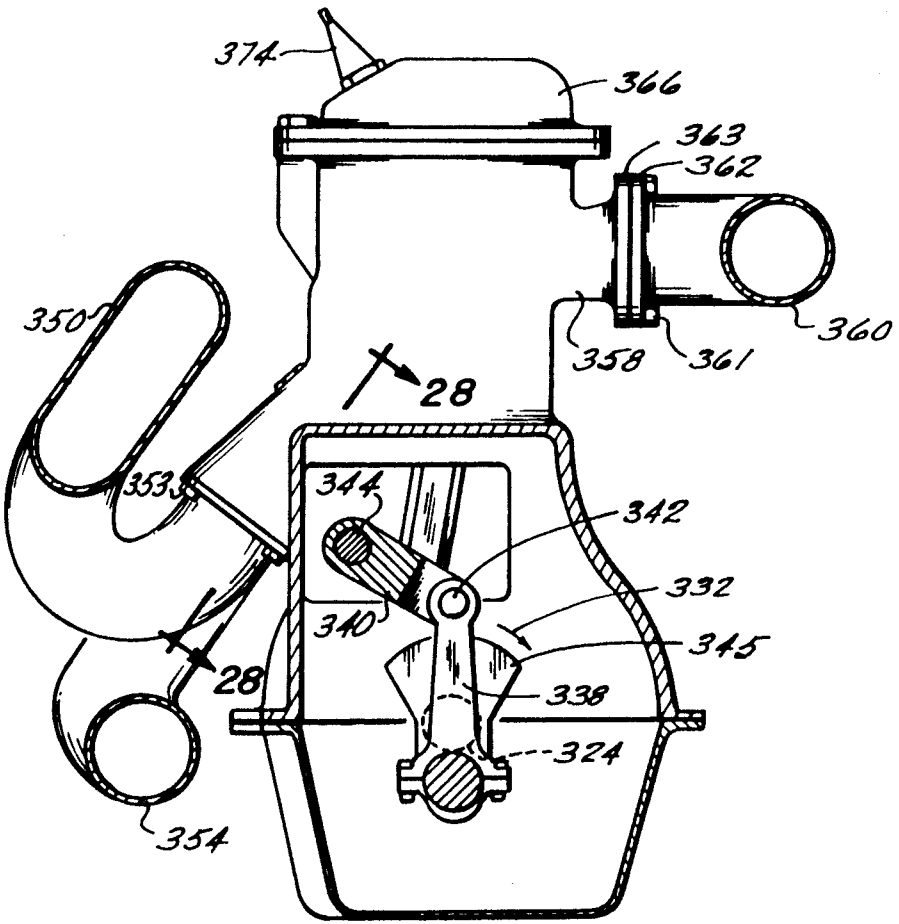
FIG. 27 is a second front view partially cross sectioned of the engine of FIG. 23.
Figure 28:
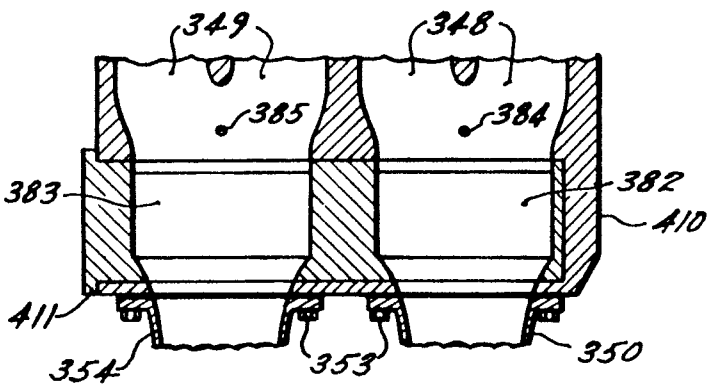
FIG. 28 is a view taken along the line 28—28 of FIG. 27.

Also referring to FIGS. 18, 22A and 22B outlet ports 224 in cylinder 208 and inlet ports 230 in cylinder 210 are connected by a biforcated transport duct 228. Exhaust ports 226 in cylinder 210 serve to discharge products of combustion therefrom.

Referring only to FIGS. 16 and 17, piston 214 includes a pair of compression rings 232 and an oil control ring 234. Piston 212 includes one compression ring 233 and one oil control ring 235. Rings 234, 235 prevent oil from reaching ports 224, 226 and 230. The diameter of piston 212 is about twice that of piston 214. Further, the maximum stroke of piston 212 is about one quarter the stroke of piston 214. Cylinders 208 and 210 each include cylinder liners 236 and 237 respectively and corresponding cylinder heads 238 and 240. Head 238 is secured on cylinder 208 by a threaded cover 242. A seal 244 is disposed peripherally about head 238. Head 240 is connected to cylinder 210 by nuts 246. A gasket 248 is disposed between cylinder head 240 and cylinder 210.

Cylinder head 240 includes an opening for mounting a spark plug 250 therein. Channels 252 in cylinder 210 define passages for a coolant. Head 238 includes an extension 254 having a passage 256 for fuel/air mixture intake (i.e., with a carburetor type engine).

Figure 19:
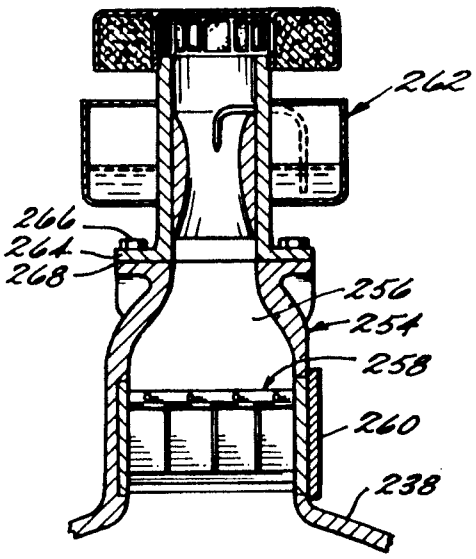
FIG. 19 is a vertically sectioned view of an extension of an aspirating cylinder head shown in FIG. 17 with a carburetor disposed thereon.

Referring also to FIG. 19, a first reed valve assembly 258 is disposed in passage 256. Reed valve assembly 258 is the same type as reed valve assembly 128 in the FIG. 2 embodiment. Valve assembly 258 is secured by an integral mounting plate 260 which is mounted to extension 254, thereby retaining valve 258 in passage 256. A carburetor 262 having flanges 264 is connected to extension 254 with studs 266. A gasket 268 is disposed between carburetor 262 and extension 254. Carburetor 262 provides the fuel/air mixture.

Two other reed valve assemblies 270 and 272 are disposed in each side of duct 228 near cylinder 210. Reed valve assemblies 270 and 272 allow flow from ports 224 to ports 230 and prohibit flow from ports 230 to ports 224. Reed valve assemblies 270 and 272 are also of the same type as reed valve assembly 128 in the FIG. 2 embodiment.

Figure 21:
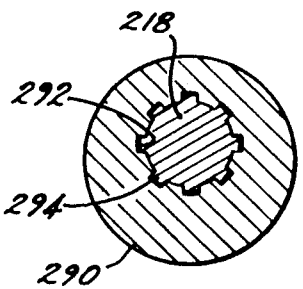
FIG. 21 is a view taken along the line 21—21 of FIG. 20.
Figure 20:
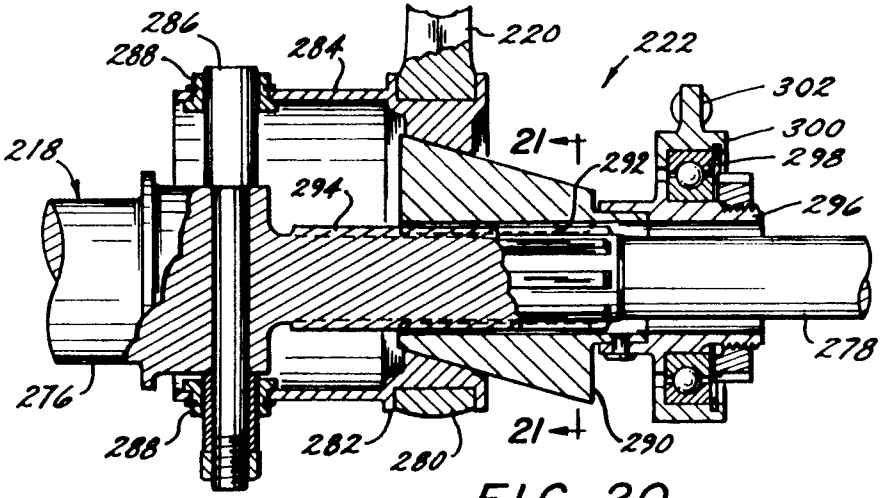
FIG. 20 is an enlarged view of a variable stroke assembly shown in FIG. 17.

Shaft 218 comprises three main bearing journals 274, 276, and 278. Referring to FIGS. 17, 20 and 21, variable stroke assembly 222 includes connecting rod assembly 280 disposed on a journal assembly 282 which is connected to an axial location skirt 284. Skirt 284 carries bushings 288 which fit over pin assembly 286 to fix the axial distance between journal assembly 282 and pin assembly 286, which consists of pin 285, sleeve 287 and nut 289. An angularly eccentric control slider 290 (FIG. 21) disposed about shaft 218 has plurality of internal splines 292. Shaft 218 has a plurality of external splines 294 interposed with splines 292, so that slider 290 rotates in unison with shaft 218. Slider 290 is axially positioned by a bearing support 296 and bearing 298. Bearing 298 is secured by a sleeve 300. Axial positioning of slider 290 on shaft 218 is varied by motion of connection 302 to an engine power control lever (not shown). This results in varying the stroke of piston 212 via rod 220 to any desired value between zero and the maximum stroke.

The timing of a cycle and flow from the aspirating cylinder 208 to the combustion cylinder 210 is the same as in the FIG. 2 embodiment. Further, the timing and operation of reed valve assemblies 258, 270 and 272 are the same as in the FIG. 2 embodiment, with the reed valve assemblies 270 and 272 performing the same function, i.e., that of valve assembly 146 in the FIG. 2 embodiment.

The fourth embodiment differs from the other embodiments in that power control is obtained by reducing the stroke of the aspirating piston, thusly reducing the quantity of flow inducted and the induction work required. It will be appreciated that the carbureted inlet depicted in FIG. 19 does not show a throttle valve. This difference in operation from the other three embodiments eliminates the need for a voluminous transport duct, as little compression and re-expansion of intake gasses is involved since the intake air is ingested at approximately full atmospheric pressure without throttling. The quantity of ingested gasses is controlled to the desired amount by varying the effective displacement of the aspirating cylinder through the use of the variale stroke feature.

It will be appreciated that a fuel injector or a carburetor may be employed with any embodiment of this invention. Further, that the engine may be a "V" configuration or an in-line engine.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A metered induction two cycle engine, comprising:

a first cylinder;

a first cylinder head being disposed on said first cylinder and defining a first outlet port, said first cylinder head having a first inlet port therein;

a second cylinder having a second inlet port and a second outlet port therein;

a second cylinder head being disposed on said second cylinder, said second cylinder head having an opening therethrough;

a duct extending from said first outlet port to said second inlet port for providing a continuous connection therebetween;

first piston means reciprocally mounted in said first cylinder;

second piston means reciprocally mounted in said second cylinder, said first piston means being at a predetermined lead angle from said second piston means;

intake means being disposed at said first inlet port of said first cylinder head;

first valve means being disposed in said intake means at said first inlet port, said first valve means for permitting flow from said intake means to said first cylinder and for prohibiting flow from said first cylinder to said intake means, said first valve means being actuated when the pressure in said intake means exceeds the pressure in said first cylinder;

second valve means being disposed in said duct near said second inlet port, said second valve means for permitting flow from said duct and said first cylinder to said second cylinder and for prohibiting flow from said second cylinder to said duct, said second valve means being actuated when the pressure in said duct exceeds the pressure in said second cylinder; and spark ignition means being disposed in said opening of said second cylinder head.

2. The engine of claim 1 further comprising:

exhaust means being disposed at said outlet port of said second cylinder.

3. The engine of claim 1 wherein said first and second valve means comprise reed valves.

4. The engine of claim 1 further comprising:

throttle means being disposed in said intake means, said throttle means for regulating flow through said intake means.

5. The engine of claim 4 further comprising:

a recess extending outwardly from said duct near said first outlet port;

linkage means being connected at one end to said throttle means; and third valve means being moveable between a first position in said recess and a second piston in said duct, said third valve means being biased in said first position, said third valve means being connected to said linkage, said third valve means in said second position permitting flow from said first cylinder to said duct and prohibiting flow from said duct to said first cylinder, said third valve means being actuated when the pressure in said first cylinder exceeds the pressure in said duct.

6. The engine of claim 5 wherein said third valve means comprises a reed valve.

7. The engine of claim 1 further comprising:

fuel injection means being disposed in said duct between said first outlet port and said second inlet port.

8. The engine of claim 1 further comprising:

carburetion means being disposed on said intake means.

9. The engine of claim 1 wherein said duct has a volume of at least one-half the displacement of said first piston means in said first cylinder.

10. The engine of claim 1 wherein the displacement of said first piston means in said first cylinder is about the same as the displacement of said second piston means in said second cylinder.

11. The engine of claim 1 further comprising:

shaft means for journaling said first and second piston means.

12. The engine of claim 1 wherein said predetermined lead angle is between 75° and 160°.

13. The engine of claim 1 wherein said first cylinder comprises a large diameter diaphragm.

14. The engine of claim 1 further comprising:

fuel injection means being disposed in said second cylinder.

15. A metered induction two cycle engine, comprising:

a first cylinder having a first outlet port therein;

a first cylinder head being disposed on said first cylinder and having a first inlet port therein;

a second cylinder having a second inlet port and a second outlet port therein;

a second cylinder head being disposed on said second cylinder, said second cylinder head having an opening therethrough;

a duct extending from said first outlet port to said second inlet port for providing a continuous connection therebetween;

first piston means reciprocally mounted in said first cylinder, said first piston means having a variable stroke;

second piston means reciprocally mounted in said second cylinder, said first piston means being a predetermined lead angle from said second piston means;

intake means being disposed at said first inlet port of said first cylinder head;

first valve means being disposed in said intake means at said first inlet port, said first valve means for permitting flow from said intake means to said first cylinder and for prohibiting flow from said first cylinder to said intake means, said first valve means being actuated when the pressure in said intake means exceeds the pressure in said first cylinder;

second valve means being disposed in said duct near said second inlet port, said second valve means for permitting flow from said duct and said first cylinder to said second cylinder and for prohibiting flow from said second cylinder to said duct, said second valve means being actuated when the pressure in said duct exceeds the pressure in said second cylinder; and spark ignition means being disposed in said opening of said second cylinder head.

16. The engine of claim 15 further comprising:

exhaust means being disposed at said outlet port of said second cylinder.

17. The engine of claim 15 wherein said first and second valve means comprise reed valves.

18. The engine of claim 15 further comprising:

fuel injection means being disposed in said duct between said first outlet port and said second inlet port.

19. The engine of claim 15 further comprising:

carburetion means being disposed on said intake means.

20. The engine of claim 15 wherein the displacement of said first piston means in said first cylinder is about the same as the displacement of said second piston means in said second cylinder.

21. The engine of claim 15 further comprising:

shaft means having a bearing journal for journaling said second piston means;

eccentric control means being axially disposed on said shaft means, said eccentric control means for journaling said first piston means; and means for varying the axial position of said eccentric control means, wherein the stroke of said first piston means is varied.

22. The engine of claim 21 further comprising:

a first plurality of splines being disposed externally about a portion of said shaft means; and a second plurality of splines being disposed internally about said eccentric control, said second splines being interposed with said first splines.

23. The engine of claim 15 wherein said predetermined lead angle is between 75° and 160°.

24. The engine of claim 15 further comprising:

fuel injection means being disposed in said second cylinder.

25. A method of metered induction for a two cycle engine, the method comprising repetitively performing an operating cycle including the steps of:

drawing an air charge from an intake means through a first valve means into a first cylinder and a transport duct by expansion of the volume of said first cylinder via a downward piston movement, said transport duct extending from said first cylinder to a second cylinder, said first valve means being actuated when the pressure in said intake means exceeds the pressure in said first cylinder;

partially compressing said air charge in said first cylinder and said transport duct;

transferring said air charge in said first cylinder and said transport duct through a second valve means to said second cylinder, said second valve means being actuated when the pressure in said transport duct exceeds the pressure in said second cylinder;

mixing fuel with said air charge to form a combustible mixture;

compressing said combustible mixture in said second cylinder by contraction thereof;

igniting said combustible mixture in said second cylinder for burning in said second cylinder;

expanding the burning and burned gases in said second cylinder by expansion thereof with an output of useful work; and exhausting a major portion of the burned gases from said second cylinder.

26. The method of claim 25 wherein said mixing fuel comprises:

mixing fuel with said air charge in said transport duct.

27. The method of claim 25 wherein said mixing fuel comprises:

mixing fuel with said air charge in said intake means.

28. The method of claim 25 wherein said first and second valve means comprise reed valves.

29. The method of claim 25 further comprising:

removeably positioning a third valve means in said transport duct at said first cylinder when additional power is requested, said third valve means being actuated when the pressure in said first cylinder exceeds the pressure in said transport duct.

30. The method of claim 29 wherein said third valve means comprises a reed valve.

31. The method of claim 25 wherein said mixing fuel comprises:

mixing fuel with said air charge in said second cylinder.

32. A metered induction two cycle engine, comprising:

a first cylinder having a first inlet port and a first outlet port therein;

a second cylinder having a second inlet port and a second outlet port therein;

a cylinder head being disposed on said first and second cylinders, said cylinder head having first and second openings therethrough;

aspirating enclosure means having third and fourth ports therein;

a first duct connecting said third port to said first inlet port;

a second duct connecting said fourth port to said second inlet port;

first piston means reciprocally mounted in said first cylinder;

second piston means reciprocally mounted in said second cylinder;

vane means pivotally mounted in said aspirating enclosure means, said vane means being at a first predetermined lead angle from said first piston and being at second predetermined lead angle from said second piston;

intake means communicating with said third and fourth ports of said aspirating enclosure means;

first valve means being disposed at said third port, said first valve means for permitting flow from said intake means to said aspirating enclosure means and for prohibiting flow from said aspirating enclosure means to said intake means, said first valve means being actuated when the pressure in said intake means exceeds the pressure in an upper portion of said aspirating enclosure means;

second valve means being disposed in said first duct near said first inlet port, said second valve means for permitting flow from said first duct and said aspirating enclosure means to said first cylinder and for prohibiting flow from said first cylinder to said first duct, said second valve means being actuated when the pressure in said first duct exceeds the pressure in said first cylinder;

third valve means being disposed at said fourth port, said third valve means for permitting flow from said intake means to said aspirating enclosure means and for prohibiting flow from said aspirating enclosure means to said intake means, said third valve means being actuated when the pressure in said intake means exceeds the pressure in a lower portion of said aspirating enclosure means;

fourth valve means being disposed in said second duct near said second inlet port, said fourth valve means for permitting flow from said second duct and said aspirating enclosure to said second cylinder and for prohibiting flow from said second cylinder to said second duct, said fourth valve means being actuated when the pressure in said second duct exceeds the pressure in said second cylinder;

first spark ignition means being disposed in said first opening of said cylinder head; and second spark ignition means being disposed in said second opening of said cylinder head.

33. The engine of claim 32 further comprising:

exhaust means communicating with said first and second outlet ports.

34. The engine of claim 32 wherein said first, second, third and fourth valve means comprise reed valves.

35. The engine of claim 32 further comprising:

first fuel injection means being disposed in said first duct between said third port and said first inlet port; and second fuel injection means being disposed in said second duct between said fourth port and said second inlet port.

36. The engine of claim 32 further comprising:

carburetion means being disposed on said intake means.

37. The engine of claim 32 further comprising:

shaft means for journaling said first and second piston means and for actuating said vane means.

38. The engine of claim 32 further comprising:

first fuel injection means being disposed in said first cylinder; and second fuel injection means being disposed in said second cylinder.

39. A pulsing air-charger comprising:

aspirating enclosure means having at least one port therein;

induction vane means pivotally mounted in said aspirating enclosure means;

intake means communicating with said port; and exhaust means communicating with said port valve means being disposed at said port, said valve means for permitting flow from said intake means to said aspirating enclosure means and for prohibiting flow from said aspirating enclosure means to said intake means, said valve means being actuated when the pressure in said intake means exceeds the pressure in a portion of said aspirating enclosure means.

40. A metered induction two cycle engine, comprising:

a cylinder having a first inlet port and a first outlet port therein;

a cylinder head being disposed on said cylinder, said cylinder head having an opening therethrough;

aspirating enclosure means having a second port therein;

a duct connecting said second port to said first inlet port;

piston means reciprocally mounted in said cylinder;

vane means pivotally mounted in said aspirating enclosure means, said vane means being at a predetermined lead angle from said piston;

intake means communicating with said second port of said aspirating enclosure means;

first valve means being disposed at said second port, said first valve means for permitting flow from said intake means to said aspirating enclosure means and for prohibiting flow from said aspirating enclosure means to said intake means, said first valve means being actuated when the pressure in said intake means exceeds the pressure in a portion of said aspirating enclosure means;

second valve means being disposed in said duct near said first inlet port, said second valve means for permitting flow from said duct and said aspirating enclosure means to said cylinder and for prohibiting flow from said cylinder to said duct, said second valve means being actuated when the pressure in said duct exceeds the pressure in said cylinder; and spark ignition means being disposed in said opening of said cylinder head.

41. The engine of claim 40 further comprising:

exhaust means communicating with said first outlet port.

42. The engine of claim 40 wherein said first and second valve means comprise reed valves.

43. The engine of claim 40 further comprising:

fuel injection means being disposed in said duct between said second port and said first inlet port.

44. The engine of claim 40 further comprising:

carburetion means being disposed on said intake means.

45. The engine of claim 40 further comprising:

shaft means for journaling said piston means and for actuating said vane means.

46. The engine of claim 40 further comprising:

fuel injection means being disposed in said cylinder.

* * * * *